US006352404B1

(12) United States Patent
Czachor et al.

(10) Patent No.: US 6,352,404 B1
(45) Date of Patent: Mar. 5, 2002

(54) THERMAL CONTROL PASSAGES FOR HORIZONTAL SPLIT-LINE FLANGES OF GAS TURBINE ENGINE CASINGS

(75) Inventors: Robert P. Czachor, Cincinnati, OH (US); Michael L. Barron, Ten Mile, TN (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/507,410

(22) Filed: Feb. 18, 2000

(51) Int. Cl.[7] ..... F01D 25/14

(52) U.S. Cl. ..... 415/116; 415/117; 415/176; 415/178; 415/214.1

(58) Field of Search ..... 415/115, 116, 415/175–178, 117, 214.1; 60/39.31, 39.83; 403/337, 338, 340, 344; 285/41

(56) References Cited

U.S. PATENT DOCUMENTS 1,058,936 A * 4/1913 Bancel ..... 415/214.1
1,828,408 A * 10/1931 Guy ..... 415/214.1
3,390,830 A * 7/1968 Kahane ..... 415/214.1
4,208,777 A * 6/1980 Walsh et al. ..... 415/214.1
5,167,485 A 12/1992 Starkweather
5,219,268 A 6/1993 Johnson
5,357,744 A 10/1994 Czachor et al.
6,267,556 B1 * 7/2001 Kikuchi et al. ..... 415/214.1

FOREIGN PATENT DOCUMENTS

SU 735810 A * 5/1980 ..... 415/214.1

* cited by examiner

*Primary Examiner*—Christopher Verdier
(74) *Attorney, Agent, or Firm*—Andrew C. Hess; Nathan D. Herkamp

(57) ABSTRACT

A casing for a gas turbine engine having a longitudinal axis extending therethrough, including a first casing portion having a substantially arcuate section and a split-line flange extending from each end thereof and a second casing portion having a substantially arcuate section and a split-line flange extending from each end thereof. The first and second casing portions are mated at each end by connecting together respective pairs of the split-line flanges. A channel is formed in at least one mating surface of the split-line flanges to provide an axial passage therethrough so that air flow provided to the axial passage reduces a temperature gradient between the arcuate sections and the flanges of the first and second casing portions. The gas turbine engine casing also includes a first radial channel formed in at least one mating surface of the split-line flanges to provide an entrance to the axial passage and a second radial channel formed in at least one mating surface of the split-line flanges to provide an exit to the axial passage so that flow communication is established between a flowpath through the casing and the axial passage.

12 Claims, 2 Drawing Sheets

THERMAL CONTROL PASSAGES FOR HORIZONTAL SPLIT-LINE FLANGES OF GAS TURBINE ENGINE CASINGS

BACKGROUND OF THE INVENTION

1. Field of the Invention

The present invention relates to the casings of compressors and turbines in a gas turbine engine and, more particularly, to the thermal control of horizontal split-line flanges associated with casings split into two halves.

2. Description of Related Art

In order to enhance ease of maintenance, casings for the turbines and/or compressors of a gas turbine engine are oftentimes split axially into two halves along a horizontal plane and then secured together by means of a series of bolts or other devices through a pair of conventional flanges in mating relation. This permits one half of the casing to be removed, giving access to the internal blades, vanes and shrouds, without disturbing the structural integrity of the turbine/compressor. Such design also permits maintenance to be performed on the turbine/compressor while the gas turbine engine is on wing.

A disadvantage of this arrangement, however, is that the horizontal split-line (HSL) flanges will be thermally mismatched with the casing skin. This stems from the casing interior wall being typically exposed to high velocity, high temperature engine cycle air (e.g., for both high pressure compressor and turbine casings) while the exterior horizontal split-line flanges are washed in the relatively low temperature, low velocity environment of the engine enclosure. Therefore, during an acceleration of the engine from ground idle to take-off power, the HSL flanges will be colder than the casing skin. The reverse occurs during deceleration of the engine from stabilized high power to idle conditions. The temperature gradient existing between the HSL flanges and the remainder of the casing has been known to cause the casing to ovalize since the HSL flange locations pinch inward towards a centerline of the casing. This behavior, in turn, causes rubs with the rotor blade tips in the high pressure turbine application, which leads to increased clearances and lower efficiency. In the high pressure compressor application, larger tip clearances will result in lower stall margin and poorer engine operability characteristics.

One solution to the above-described problems has been to eliminate the HSL flanges by using a 360° casing. While the thermal mismatch is eliminated, such a design requires the rotor to be assembled simultaneously with the stator. The rotor balance operation must then be accomplished while in the stator assembly. Moreover, as detailed above, a significant maintainability issue is associated with this type of design.

Accordingly, it is desirable for a gas turbine engine casing to be developed for use with both compressors and turbines which provides the ease of access for maintenance purposes exhibited by split-line casings and minimizes any thermal mismatch between the HSL flanges and the rest of the casing.

SUMMARY OF THE INVENTION

In accordance with one aspect of the present invention, a casing for a gas turbine engine having a longitudinal axis extending therethrough is disclosed as including a first casing portion and a second casing portion. Each casing portion has a substantially arcuate section and a split-line flange extending from the ends thereof. The first and second casing portions are mated at each end by connecting together respective pairs of the split-line flanges. A channel is formed in at least one mating surface of the split-line flanges to provide an axial passage therethrough so that air flow provided to the axial passage reduces a temperature gradient between the arcuate sections and the split-line flanges of the first and second casing portions. The gas turbine engine casing also includes a first radial channel formed in at least one mating surface of the split-line flanges to provide an entrance to the axial passage and a second radial channel formed in at least one mating surface of the split-line flanges to provide an exit to the axial passage so that flow communication is established between a flowpath through the casing and the axial passage.

In accordance with a second aspect of the present invention a split-line flange for a casing portion of a gas turbine engine is disclosed where the casing has a longitudinal axis extending therethrough. The split-line flange includes a forward end, an aft end, a first side connected to an end of a substantially arcuate casing section, a second distal side opposite the first side, a first surface located between the first and second sides which mates with an adjacent split-line flange of a second casing portion, and a second exterior surface opposite the first surface. A channel is formed in the first surface generally extending from said forward end to said aft end so as to provide an axial passage when the split-line flange is mated with the adjacent split-line flange. The split-line flange further includes a first radial channel formed in the first surface to provide an entrance to the axial passage and a second radial channel formed in the first surface to provide an exit from the axial passage.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
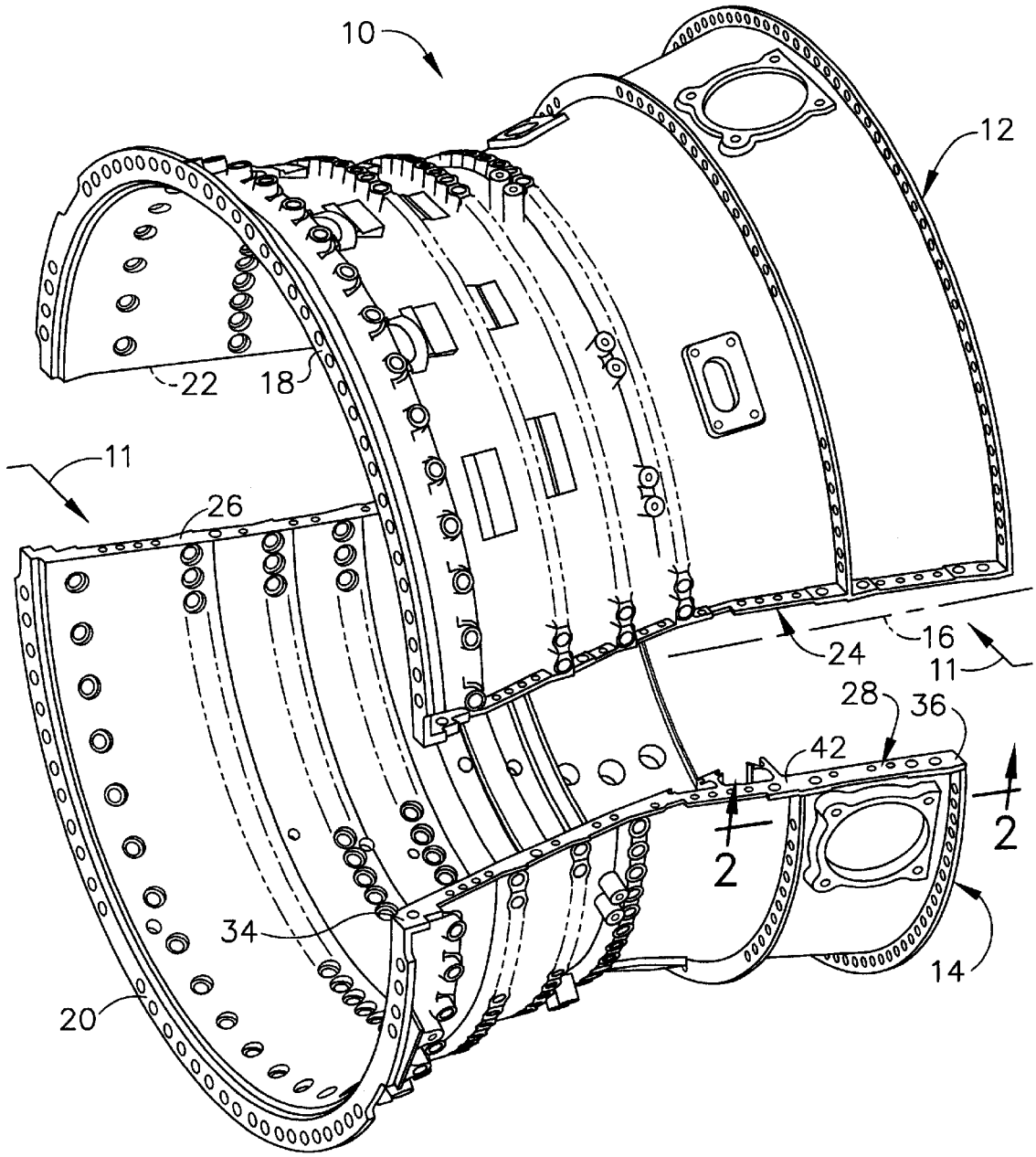
FIG. 1 is a perspective view of a gas turbine engine casing in accordance with the present invention, where the casing halves are separated for simplicity.
Figure 2:
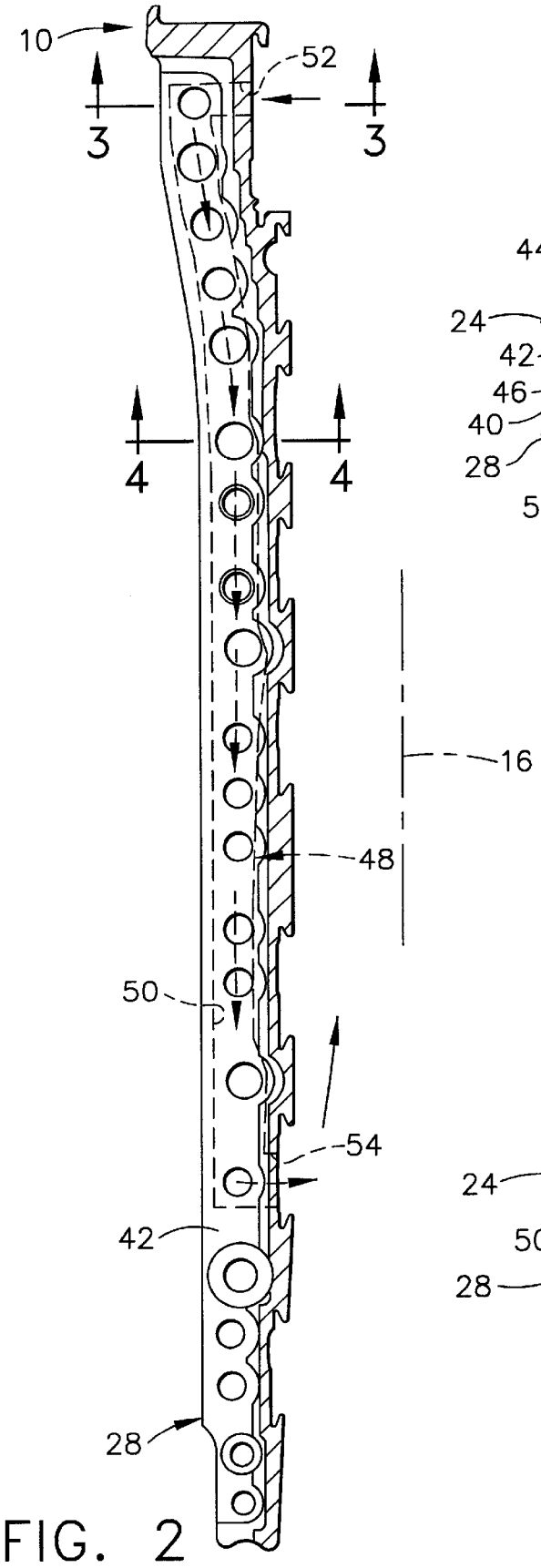
FIG. 2 is a top partial view of a horizontal split-line flange the casing depicted in FIG. 1.

Referring now to the drawing in detail, wherein identical numerals indicate the same elements throughout the figures, FIG. 1 depicts a casing 10 utilized with a turbine and/or compressor of a gas turbine engine split axially along a horizontal plane 11 so as to include a pair of casing halves 12 and 14. In this way, one of the casing halves may be removed so that access to the internal components of the turbine/compressor can be accomplished for maintenance purposes. It will be appreciated that a longitudinal axis 16 is provided in FIG. 1 for reference purposes.

More specifically, casing halves 12 and 14 each include a substantially arcuate section 18 and 20, respectively, as well as a pair of horizontal split-line flanges 22, 24 and 26, 28 at each end of and oriented substantially perpendicular to arcuate sections 18 and 20. It will be appreciated that casing halves 12 and 14 are then mated and connected together when a split-line flange for each (e.g., flanges 22 and 26 and flanges 24 and 28) are brought together and connected via bolts 30 (see FIGS. 3 and 4) or some other suitable fastening device.

Figure 3:
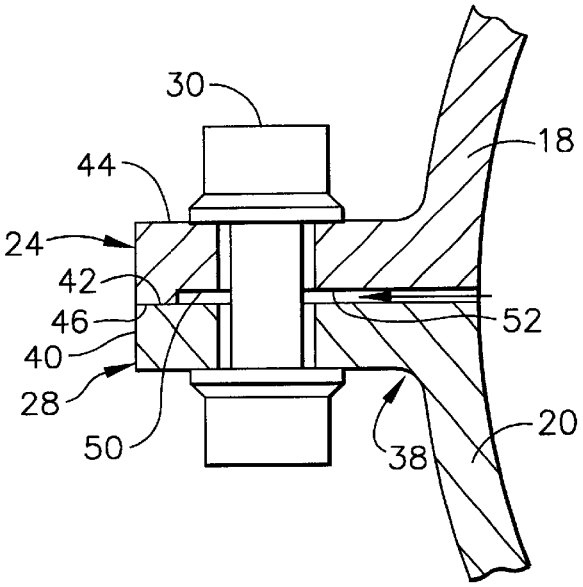
FIG. 3 is a cross-sectional view of a pair of mated horizontal split-line flanges for the casing depicted in FIG. 1 taken along lines 3—3 of FIG. 2.
Figure 4:
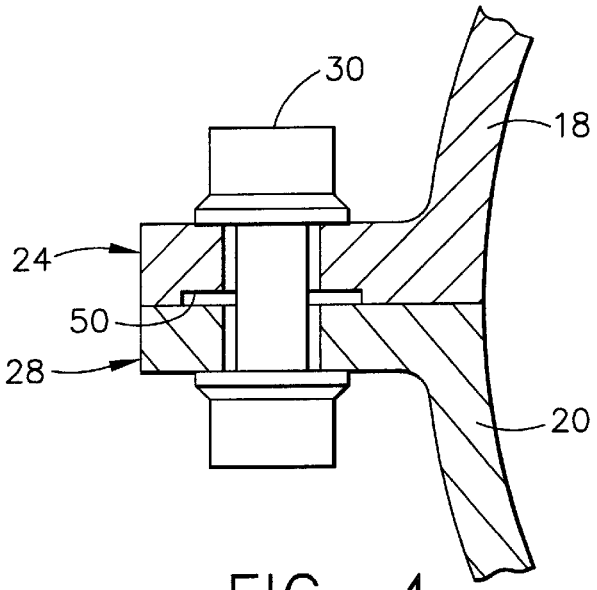
FIG. 4 is a cross-sectional view of the mated horizontal split-line flanges depicted in FIG. 3 taken along lines 4—4 of FIG. 2.

With respect to each split-line flange 22, 24, 26 and 28, it will be seen that such flanges are shaped in accordance with a cross-section of casing portions 12 and 14 and, in reference to split-line flange 28 (see FIG. 1), include a forward end 34, an aft end 36, a first side 38 connected to arcuate section 20, and a second distal side 40 located opposite first side 38 (FIG. 3). It will also be seen that split-line flange 28 has a first surface 42 which is brought in mating relation with a like surface 46 of split-line flange 24 and an exterior surface 44 opposite first surface 42 (see FIGS. 3 and 4).

Because it has been found that a significant thermal gradient exists between each split-line flange 22, 24, 26, and 28 and the rest of casing halves 12 and 14, where ovalization of casing 10 can be created, some type of thermal control is required. In accordance with the present invention, it is preferred that a channel 48 be formed in at least one of mating surfaces 42 and 46 to provide an axial passage 50 (i.e., a passage substantially parallel to longitudinal axis 16) through the connection of split-line flanges 28 and 24. In this way, air flow supplied to axial passage 50 is able to reduce the temperature gradient between arcuate sections 18 and 20 and split-line flanges 24 and 28, respectively. It will be appreciated that a similar axial passage is preferably formed in the mating surfaces of split-line flanges 22 and 26 for the same purpose.

In order to establish flow communication between engine cycle air flowing within casing 10, first and second radial channels 52 and 54 are formed in at least one of mating surfaces 42 and 46 to provide an entrance and an exit to axial passage 50. It will be appreciated that a pressure differential will exist between the entrance and exit of axial passage 50 so that air is driven therethrough. In the instance where casing 10 is for a compressor, the air flow is directed from aft end 36 to forward end 34 of split-line flange 28 since the air enters through the higher pressure stages of such compressor at first radial channel 52 and exits into the lower pressure stages of such compressor at second radial channel 54. By contrast, air flow is directed from forward end 34 to aft end 36 of split-line flange 28 when casing 10 is utilized with a turbine, as air enters through the higher pressure stages of the turbine at second radial channel 54 and exits into the lower pressure stages at first radial channel 52.

It will be understood that the sizing, location, and configuration of axial passage 50, as well as first and second radial channels 52 and 54, is preferably undertaken in a manner to optimize the thermal response of split-line flanges 28 and 24. For example, axial passage 50 may be configured so as to have a steadily increasing cross-sectional area from aft end 36 to forward end 34. This would serve to decrease the flow velocity and heat transfer coefficient on the forward stages, where less thermal mismatch exists, and maximize these effects toward aft end 36. In any case, the passages formed through the mating of a pair of split-line flanges is able to assist in controlling the rate of heat-up or cool-down experienced by the flanges, thereby minimizing out of round distortion.

Having shown and described the preferred embodiment of the present invention, further adaptations of the gas turbine engine casing, and particularly the split-line flanges thereof, can be accomplished by appropriate modifications by one of ordinary skill in the art without departing from the scope of the invention. In particular, it will be noted that the thermal control passages of the present invention are preferably applied to each split-line flange.

What is claimed is:

1. A compressor casing for a gas turbine engine having a longitudinal axis extending therethrough, comprising:

(a) a first casing portion having a substantially arcuate section and a split-line flange extending from each end thereof, each said split-line flange including a mating surface thereon; and (b) a second casing portion having a substantially arcuate section and a split-line flange extending from each end thereof, each said split-line flange including a mating surface thereon, said first and second casing portions being mated at each end by respective pairs of said split-line flanges;

wherein a first radial channel at an upstream end, a second radial channel at a downstream end, and an axial channel connecting said first and second radial channels are formed in at least one mating surface of each pair of said split-line flanges to provide an axial passage therethrough having an entrance and an exit in flow communication with an internal portion of said compressor casing so that engine cycle air provided to said axial passage flows from said downstream end to said upstream end and exits into lower pressure stages of said compressor in order to reduce a temperature gradient between said arcuate sections and said split-line flanges of said first and second casing portions.

2. The compressor casing of claim 1, wherein said axial passage increases in cross-sectional area from said entrance to said exit.

3. The compressor casing of claim 1, wherein said axial passage is configured to attain a flow velocity and heat transfer coefficient at various points in accordance with the thermal mismatch between said arcuate sections and said flanges of said compressor casing.

4. The compressor casing of claim 1, wherein said axial passage extends substantially across said split-line flanges.

5. A turbine casing for a gas turbine engine having a longitudinal axis extending therethrough, comprising:

(a) a first casing portion having a substantially arcuate section and a split-line flange extending from each end thereof, each said split-line flange including a mating surface thereon; and (b) a second casing portion having a substantially arcuate section and a split-line flange extending from each end thereof, each said split-line flange including a mating surface thereon, said first and second casing portions being mated at each end by respective pairs of said split-line flanges;

wherein a first radial channel at a downstream end, a second radial channel at an upstream end, and an axial channel connecting said first and second radial channels are formed in it least one mating surface of each pair of said split-line flanges to provide an axial passage therethrough having an entrance and an exit in flow communication with an internal portion of said turbine casing so that engine cycle air provided to said axial passage flows from said upstream end to said downstream end and exits into lower pressure stages of said turbine in order to reduce a temperature gradient between said arcuate sections and said split-line flanges of said first and second casing portions.

6. The turbine casing of claim 5, wherein said axial passage extends substantially across said split-line flanges.

7. The turbine casing of claim 5, wherein said axial passage increases in cross-sectional area from said entrance to said exit.

8. The turbine casing of claim 5, wherein said axial passage is configured to attain a flow velocity and heat transfer coefficient at various points in accordance with the thermal mismatch between said arcuate sections and said flanges of said turbine casing.

9. A split-line flange for a casing portion of a gas turbine engine compressor, said casing portion having a longitudinal axis extending therethrough, comprising:

(a) an upstream end;

(b) a downstream end;

(c) a first side connected to a substantially arcuate section of said compressor casing portion;

(d) a second side opposite said first side; and (e) a surface located between said first and second sides for mating with an adjacent split-line flange of a second compressor casing portion, wherein an axial channel, a first radial channel in flow communication with said axial channel and said first side adjacent said upstream end, and a second radial channel in flow communication with said axial channel and said first side at said downstream end is formed in said surface to form a flowpath from an interior of said compressor casing portion through said split-line flange into lower pressure stages of said compressor.

10. The split-line flange of claim 9, wherein said axial channel increases in cross-sectional area from said downstream end to said upstream end.

11. The split-line flange of claim 9, wherein said axial channel is configured to attain a flow velocity and heat transfer coefficient at various points in accordance with the thermal mismatch between said arcuate section of said compressor casing portion and said split-line flange of said compressor casing portion.

12. The compressor casing of claim 9, wherein said axial channel extends substantially thereacross.

* * * * *